US007448817B2

(12) United States Patent
Lin

(10) Patent No.: US 7,448,817 B2
(45) Date of Patent: Nov. 11, 2008

(54) WRITING IMPLEMENT WITH MAGNIFIER

(76) Inventor: Keh-I Lin, 7-3F., No. 454, Ta Ya Rd., North District, Taichung City (TW)

( * ) Notice: Subject to any disclaimer, the term of this patent is extended or adjusted under 35 U.S.C. 154(b) by 151 days.

(21) Appl. No.: 11/530,486

(22) Filed: Sep. 11, 2006

(65) Prior Publication Data

US 2008/0063461 A1 Mar. 13, 2008

(51) Int. Cl.
*B43K 29/00* (2006.01)
*B43K 5/12* (2006.01)

(52) U.S. Cl. ..... 401/195; 401/192

(58) Field of Classification Search ..... 401/192, 401/195, 116, 117
See application file for complete search history.

(56) References Cited

U.S. PATENT DOCUMENTS 1,943,048 A * 1/1934 Wallace ..... 401/92
1,986,372 A * 1/1935 Sherman ..... 401/192
6,113,295 A * 9/2000 Bordelon ..... 401/195

* cited by examiner

*Primary Examiner*—David J Walczak
(74) *Attorney, Agent, or Firm*—Leong C. Lei

(57) ABSTRACT

A writing implement includes a hollow tubular barrel having a side wall in which at least one set of two opposite window openings is defined, an optic member received in the barrel and forming a lens portion corresponding to each set of window openings, a sleeve fit over the barrel and having a side wall forming openings corresponding to the window openings of the barrel; and a head portion mounted to an end of the barrel and receiving therein a writing stem that is retractably extendable out of the head portion. With such an arrangement, a writing implement is combined with an optic member for visual observation as a single unitary device to provide advantages of being easily carried and conveniently use.

16 Claims, 5 Drawing Sheets

WRITING IMPLEMENT WITH MAGNIFIER

BACKGROUND OF THE INVENTION (a) Technical Field of the Invention

The present invention relates generally to a writing implement, and in particular to a writing implement with a magnifier.

(b) Description of the Prior Art

A writing implement often provides only the function of writing, and does not have any measure for visual assistance for a writer in doing writing. Aging is often the reason for visual degradation and spectacles for vision correction are thus required, especially in doing writing. However, besides writing and reading, those aged persons do not need the spectacles for most of the daily activities. Thus, wearing or carrying a pair of spectacles just for few times of reading and writing in daily living is certainly troublesome. It is thus desired to combine a magnifier with a writing implement in order to facilitate people to read and write without additionally carrying spectacles. This not only reduces the user's burden of carrying a pair of spectacles, but is also very practical for aged people to handle their daily living with convenience.

SUMMARY OF THE INVENTION

The primary purpose of the present invention is to provide a writing implement that is provided with a measure for facilitating visual observation of a user. Besides the functions of writing and assistance of visual observation, the writing implement of the present invention further provide the function of laser pointing.

To achieve the above objective, in accordance with the present invention, a writing implement comprises a hollow tubular barrel having a side wall in which at least one set of two opposite window openings is defined, an optic member received in the barrel and forming a lens portion corresponding to each set of window openings, a sleeve fit over the barrel and having a side wall forming openings corresponding to the window openings of the barrel, and a head portion mounted to an end of the barrel and receiving therein a writing stem that is retractably extendable out of the head portion.

With such an arrangement, the present invention provides the following advantages:

(1) The optic member that is received in the barrel can be rotated between an operation position for assisting visual observation of a user and a stowed position where the lens portion is shielded and thus protected so that the writing implement effects both visual observation assistance and writing.

(2) The writing implement and the optic member are integrated together as a unitary device so that the total amount of space occupied by both is reduced and they can be carried conveniently.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
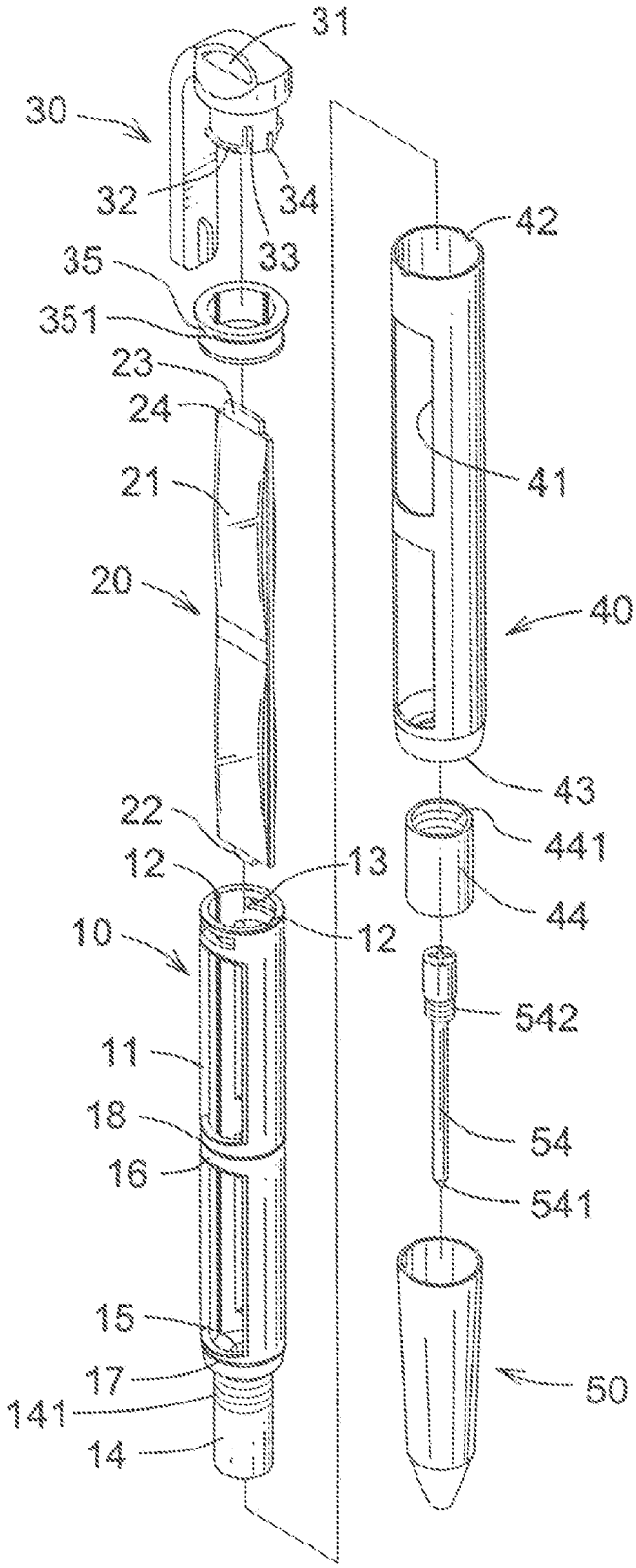
FIG. 1 is an exploded view of a writing implement constructed in accordance with a preferred embodiment of the present invention.

With reference to the drawings and in particular to FIG. 1, a writing implement constructed in accordance with the present invention comprises a barrel 10, an optic member 20, generally in the form of a plate, received in the barrel 10, a barrel cap 30 fit to an end of the barrel 10, a sleeve 40 fit over an outer circumference of the barrel 10, and a head portion 50 mounted to an end of the barrel 10 opposite to the barrel cap 30.

Figure 2:
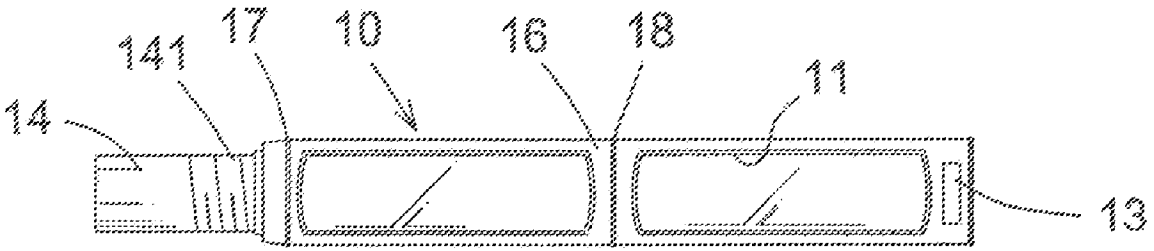
FIG. 2 is a plain view of a barrel of the writing implement of the present invention.
Figure 3:
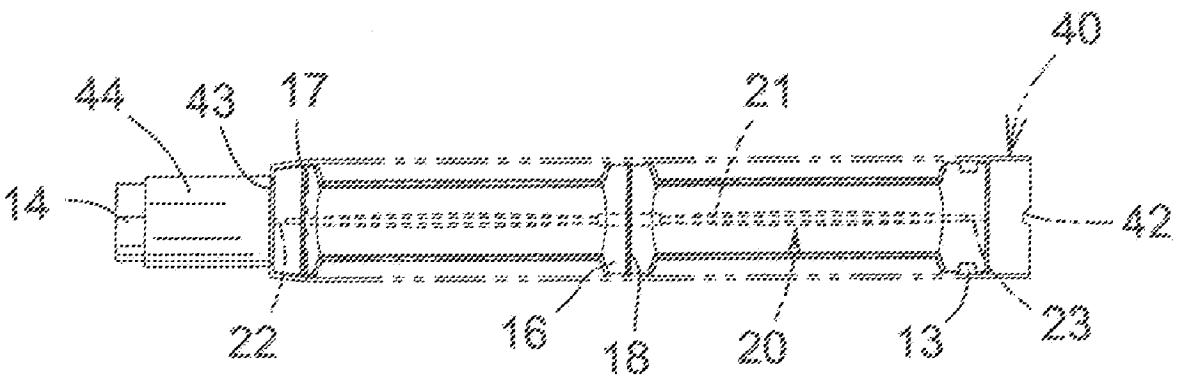
FIG. 3 is a plain view of an assembly of the combination of the barrel with a sleeve, both constituting in part the writing implement of the present invention.

Also referring to FIGS. 2 and 3, the barrel 10 comprises a hollow tubular body having a circumferential side wall in which at least one set of window openings 11 that are diametrically opposite to each other is defined. In the embodiment illustrated, two sets, each comprising two diametrically opposite openings 11, are formed in the side wall of the barrel 10. Preferably, the openings 11 are of rectangular shape and are arranged in line with each other in the axial direction of the barrel 10. The side wall of the barrel 10 forms positioning means on the inside surface thereof and preferably and as shown in the drawings, the positioning means comprises two easily-extending and diametrically opposite receiving slots 12 formed on an inside surface of the side wall of the barrel 10. The barrel 10 also forms at least one transverse retention hole 13, which can be elongated in the circumferential direction, at the end corresponding to the barrel cap 30, and a cylinder 14 is integrally formed with the end of the barrel 10 that is opposite to the end where the retention hole 13 is formed. The cylinder 14 has an inside diameter smaller than the inside diameter of the barrel 10. The cylinder 14 has an externally-threaded section 141 adjacent to the barrel 10. The barrel 10 and the cylinder 14 are arranged to communicate each other with a hole 15 connecting therebetween. The barrel 10 forms a circumferential projection 17 around the outer circumference thereof at the end adjacent to the cylinder 14.

Between the two sets of openings 11, the barrel 10 has a waist portion 16 around which a second circumferential projection 18 is formed.

The optic member 20 is axially disposed into the barrel 10 and fit into the receiving slots 12. The optic member 20 forms a lens portion 21 corresponding in position to each set of opposite openings 11 of the barrel 10. In the embodiment illustrated, the optic member 20 forms two lens portions 21 respectively corresponding to the two sets of openings 11 of the barrel 10. Preferably, the lens portions 21 are configured as convex lens, which can serve as a magnifier for prebyobia. Apparently, the lens portion 21 can be configured as other optic element, if desired. An end of the optic member 20 forms an insertion tab 22 that is fit into the hole 15 between the barrel 10 and the cylinder 14, and the opposite end of the optic member 20 forms an engaging tab 23, and two shoulders 24 on opposite sides of the engaging tab 23.

The barrel cap has a top portion in which a through hole 31 is formed and a bottom portion fit into the barrel 10. The bottom portion of the barrel cap 30 forms a raised flange 32 fit into and retained in each retention hole 13 of the barrel 10 so as to retain the barrel cap 30 in the retention hole 13. Preferably, the barrel 10 has two retention holes 13 diametrically opposite to each other, and correspondingly, the barrel cap 30 forms two raised flanges 32 respectively engaging the retention holes 13. The bottom portion of the barrel cap 30 also forms two axially extending ribs 34, preferably alternating the two raised flanges 32. When the barrel cap 30 is fit into the barrel 10, the ribs 34 are received in the receiving slots 12 of the barrel 10 and a lower edge of the barrel cap 30 abuts against the shoulders 24 of the optic member 20 to secure the optic member 20 in the barrel 10. Slits 33 are defined in the bottom portion of the barrel cap 30 on opposite sides of the ribs 34 so as to divide the bottom portion of the barrel cap 30 into four segments. A positioning ring 35 is fit over the bottom portion of the barrel cap 30 and a top rim of the positioning ring 35 forms at least one positioning piece, which preferably comprises two circumferentially spaced positioning beads 351. A clip 36 is mounted to a side of the barrel cap 30 and extends axially therefrom.

The sleeve 40 is fit over the outer circumference of the barrel 10. The sleeve 40 has a circumferential side wall in which openings 41 are defined, corresponding to the openings 11 of the barrel 10. Positioning means is formed on a top edge of the sleeve for engaging the positioning piece of the positioning ring 35. In the embodiment illustrated, the positioning means comprises two spaced dimples or notches 42 engageable with the positioning beads of the positioning ring 35. Further, sleeve 40 is sized to have an inside diameter engageable with the second circumferential projection 18 of the barrel 10 so that when the sleeve 40 is fit over the barrel 10 to a desired position by means of for example rotation, the engagement between the inside diameter of the sleeve 40 and the second circumferential projection 18 prevent the sleeve 40 from being easily rotated again. The sleeve 40 forms a converging end opening 43 that internally engages the first circumferential projection 17 of the barrel 10 to prevent the barrel 10 from sliding off the sleeve 40 through the end opening 43 of the sleeve 40. A collar 44 is fit over the cylinder 14 and has an internal threading 441 engaging the threaded section 141 of the cylinder 14 thereby fixing the collar 44 to the cylinder 14. The collar 44 that is threadingly secured to the cylinder 14 securely retains the barrel 10 inside the sleeve 40.

Figure 4:
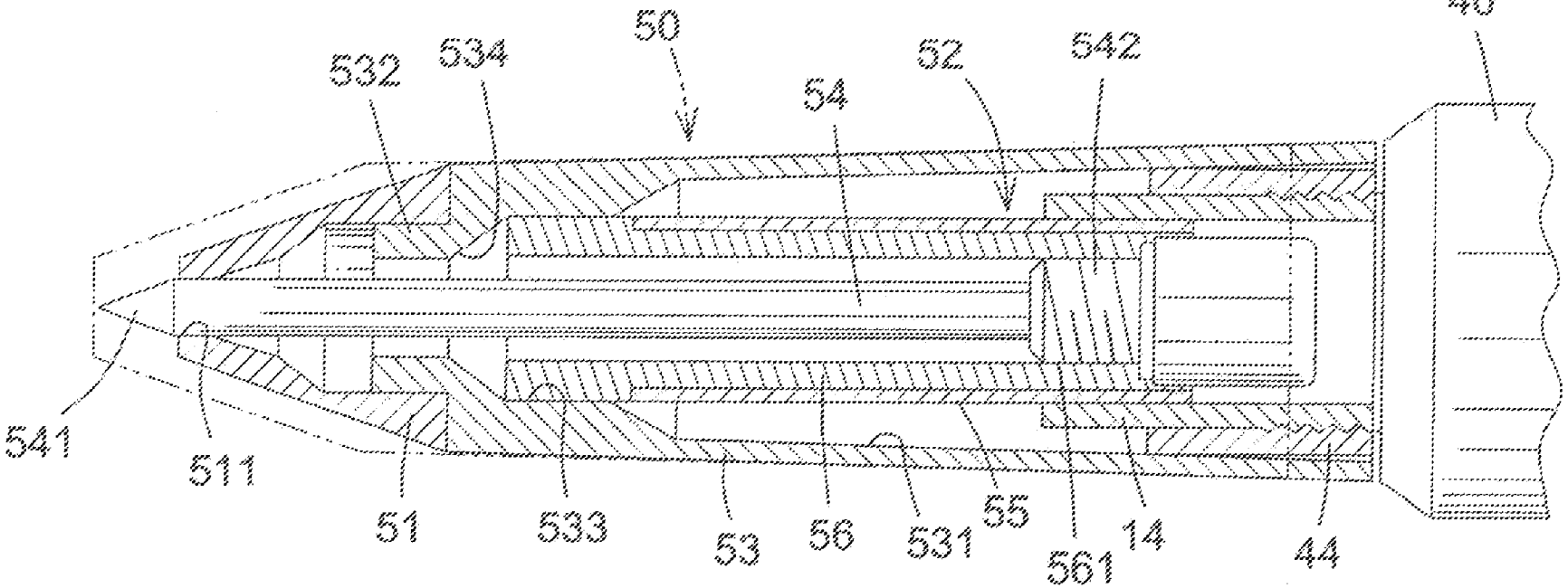
FIG. 4 is a cross-sectional view of a head portion of the writing implement of the present invention.

Also referring to FIG. 4, the head portion 50 is fit over the cylinder 14 of the barrel 10 and comprises a tub 53 surrounding the cylinder 14, and end cover 51 mounted to an end of the tub 53, and a writing stem 52 axially received in the tub 53 in a manner of retractably extending beyond the end cover 51. The tub 53 defines a hollow interior chamber 531 therein and forms a connection portion 532 at an end. A coupling portion 533 and an inclined stop 534 are formed on an inside surface of the chamber 531 adjacent to the end where the connection portion 532 is provided. The end cover 51 is fit over and fixed to the connection 532 of the tub 53 and forms a through hole 511 through which an end of the writing stem 52 is extendable beyond the end cover 51. The writing stem 52 that is received in the tub 53 comprises a core 54 and a jacket 55 that retains the core 54 and engages the coupling portion 533 of the tub 53. An end of the core 54 that is extendable beyond the end cover 51 forms a writing tip 541 and an opposite end of the core 54 is a threaded end 542. The length of the writing tip 541 is shorter than the depth of the coupling portion 533 and the tub 53. The core 54 extends through the jacket 55 with the threaded end 542 of the core 54 engaging the inside diameter of an end of the jacket 55. The jacket 55 is preferably made of two components of different materials, including a metal cylindrical portion and a plastic tube 56 tightly fit in the metal cylindrical portion. Preferably, the plastic tube 56 projects beyond an end of the metal cylindrical portion and fit in and fixed to the coupling portion 533 of the tub 53. To use the writing implement, the head portion 50 is driven toward the barrel 10 by pushing or rotating so that the jacket 55 of the writing stem 52 moves toward the coupling portion 533 of the tub 53. This makes the writing tip 541 of the core 54 extending beyond the end cover 51 through the hole 511 until the jacket 55 engages and is thus stopped by the inclined stop 534. To retract the writing implement, the tub 53 is driven in a direction away from the barrel 10 by means of pulling or rotating so that the end cover 51 re-houses the writing tip 541 of the core 54. Since the depth of the coupling portion 533 is greater than the length of the writing tip 541, the writing stem 52 does separate from the tub 53.

Figure 5:
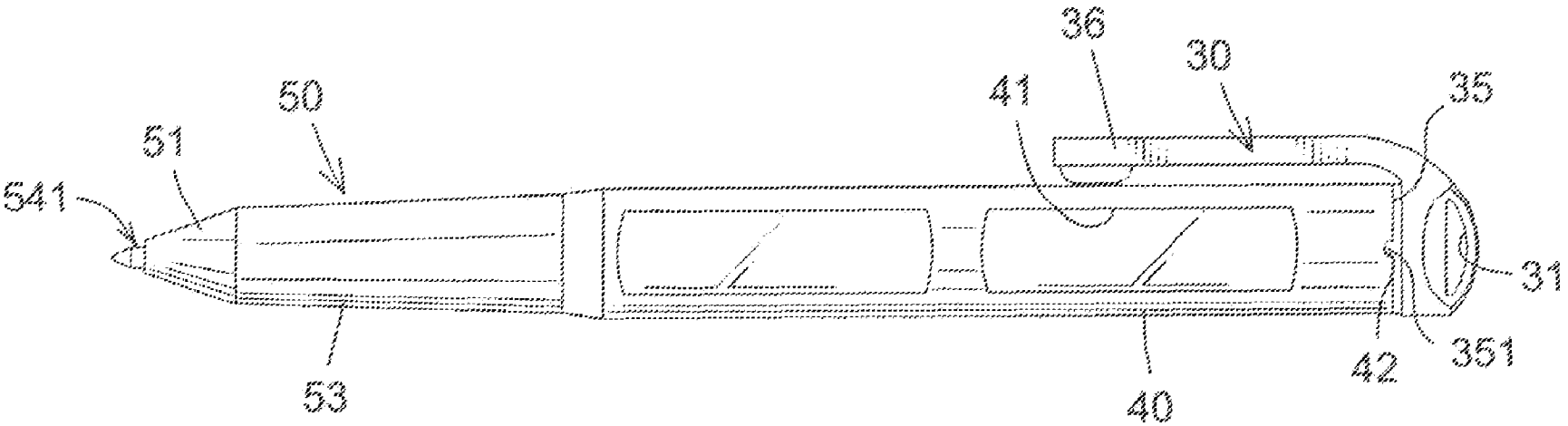
FIG. 5 is a plan view illustrating an operation condition of the writing implement of the present invention.

Also referring to FIG. 5, to use the writing implement of the present invention, a user may arbitrarily select either one of the optic function provided by the optic member 20 or the regular writing function. To use the writing implement as an observing measure, the user rotates the barrel cap 30 and thus simultaneously rotates the barrel 10 and the optic member 20 fit in the barrel 10 so as to align the lens portions 21 of the optic member 20 with the openings 41 of the sleeve 40 to allow visual observation through the lens portions 21. To do writing with the writing implement of the present invention, the tub 53 is pushed toward the sleeve 40 to expose the writing tip 541 of the core 54 so as to effect writing.

Figure 6:
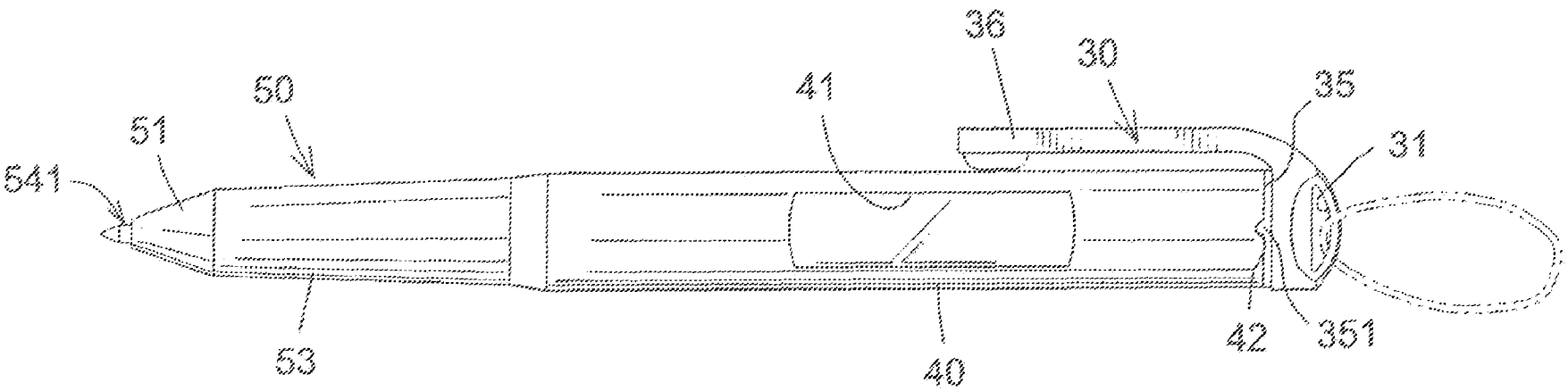
FIG. 6 is a plain view of a modification of the writing implement of the present invention.

The present invention may further comprises a wire (not labeled) extending through the through hole 31 defined in the barrel cap 30 for easy carrying and hanging of the writing implement of the present invention, as shown in FIG. 6. In addition, the writing implement of the present invention may further comprise a projection lighting device mounted to the sleeve 40. It is preferably the projection lighting device comprises a laser pointer with a power source arranged inside the barrel cap 30 to provide versatile applications of the writing implement of the present invention. Moreover, the writing tip 541 can be configured as a PDA (personal digital assistant) writing device to further provide versatile applications.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A writing implement comprising:

a hollow tubular barrel having a side wall in which at least one set of window openings is defined, each set comprising two opposite openings;

an optic member received in the barrel, the optic member forming a lens portion corresponding to each set of window openings;

a sleeve fit over the barrel and having a side wall forming openings corresponding to the window openings of the barrel; and a head portion mounted to an end of the barrel and receiving therein a writing stem that is retractably extendable out of the head portion.

2. The writing implement as claimed in claim 1, wherein the barrel defines two sets of window openings, the window openings of each set being opposite to each other, and wherein the optic member forms two lens portions corresponding to the two sets of window openings respectively.

3. The writing implement as claimed in claim 1, wherein the side wall of the barrel forms two axially-extending opposite receiving slots on an inside surface thereof and wherein the optic member is axially fit in the receiving slots.

4. The writing implement as claimed in claim 3, wherein the barrel forms at least one transverse retention hole at one end thereof, a barrel cap being mounted to the end of the barrel by being fixed in the retention hole, the barrel cap having a side face to which a clip is attached.

5. The writing implement as claimed in claim 4, wherein the barrel cap has a top portion in which a through hole is defined and a bottom portion forming at least one raised flange, the bottom portion also forming two axially extending ribs at locations different from the raised flange for being fit into the receiving slots of the barrel such that a lower edge of the barrel cap abuts against the optic member.

6. The writing implement as claimed in claim 4 further comprising a positioning ring fit over the barrel cap, and wherein the positioning ring has a top rim on which at least one positioning piece is formed, the sleeve forming positioning means corresponding to the positioning piece at an end thereof opposite to a converging end opening.

7. The writing implement as claimed in claim 4, wherein the sleeve has a converging end opening and wherein the barrel has an end, which is opposite to the end where the retention hole is formed, and which forms a cylinder that extends through and beyond the converging end opening, the cylinder also forming a threaded section adapted to threadingly engage a collar, the barrel comprising a first circumferential projection formed at the end thereof adjacent to the cylinder for engaging the converging end opening.

8. The writing implement as claimed in claim 7, wherein the head portion is fit over the cylinder and comprising a tub surrounding and coupled to the cylinder, an end cover mounted to an end of the tub, and the writing stem axially received in the tub in a manner of retractably extending beyond the end cover.

9. The writing implement as claimed in claim 8, wherein the barrel cap has a top portion in which a through hole is defined and a bottom portion forming at least one raised flange, the bottom portion also forming two axially extending ribs at locations different from the raised flange for being fit into the receiving slots of the barrel such that a lower end of the barrel cap abuts against the optic member.

10. The writing implement as claimed in claim 9, wherein the bottom portion of the barrel cap forms two raised flanges alternating the ribs, and a slit is defined in the bottom portion at each side of each rib.

11. The writing implement as claimed in claim 10 further comprising a wire extending through the through opening of the barrel cap.

12. The writing implement as claimed in claim 11 further comprising a positioning ring fit over the barrel cap, and wherein the positioning ring has a top rim on which at least one positioning piece is formed, the sleeve forming positioning means corresponding to the positioning piece at an end thereof opposite to the converging end opening.

13. The writing implement as claimed in claim 12, wherein the at least one positioning piece includes two spaced positioning beads and wherein the positioning means includes two notches corresponding to the beads.

14. The writing implement as claimed in claim 13, wherein the tub defines a hollow interior chamber, and also forms a connection portion at an end, the chamber forming on an inside surface thereof a coupling portion and an inclined stop, the end cover being fit to the connection portion and defining a through hole, the writing stem received in the tub and comprising a core and a jacket that retains the core and engages the coupling portion of the tub, the core having a writing tip having a length shorter than depth of the coupling portion.

15. The writing implement as claimed in claim 13, wherein the core forms a threaded end, which is opposite to the writing tip, for threadingly engaging the jacket.

16. The writing implement as claimed in claim 1, wherein the sleeve has a converging end opening and wherein the barrel has an end, which is opposite to the end where a retention hole is formed, and which forms a cylinder that extends through and beyond the converging end opening, the cylinder also forming a threaded section adapted to threadingly engage a collar, the barrel comprising a first circumferential projection formed at the end thereof adjacent to the cylinder for engaging the converging end opening.

* * * * *